US009444128B2

(12) United States Patent
Lee et al.

(10) Patent No.: US 9,444,128 B2
(45) Date of Patent: Sep. 13, 2016

(54) ELECTRONIC DEVICE HAVING ANTENNA STRUCTURE

(71) Applicants: Li-Chun Lee, Taipei (TW); Chieh-Tsao Hwang, Taipei (TW); Shih-Chia Liu, Taipei (TW); Yen-Hao Yu, Taipei (TW); Jhin-Ciang Chen, Taipei (TW)

(72) Inventors: Li-Chun Lee, Taipei (TW); Chieh-Tsao Hwang, Taipei (TW); Shih-Chia Liu, Taipei (TW); Yen-Hao Yu, Taipei (TW); Jhin-Ciang Chen, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 0 days.

(21) Appl. No.: 14/557,453

(22) Filed: Dec. 2, 2014

(65) Prior Publication Data

US 2015/0295303 A1 Oct. 15, 2015

Related U.S. Application Data

(60) Provisional application No. 61/979,505, filed on Apr. 14, 2014.

(51) Int. Cl.

| | |
|---|---|
| ***H01Q 1/22*** | (2006.01) |
| ***H01Q 1/24*** | (2006.01) |
| ***H01Q 13/10*** | (2006.01) |
| ***H01Q 9/42*** | (2006.01) |
| ***H01Q 21/28*** | (2006.01) |

(52) U.S. Cl.

CPC ..... *H01Q 1/2266* (2013.01); *H01Q 9/42* (2013.01); *H01Q 13/10* (2013.01); *H01Q 21/28* (2013.01)

(58) Field of Classification Search

CPC .. H01Q 1/2266; H01Q 1/2258; H01Q 1/243; H01Q 9/42; H01Q 13/10; H01Q 21/0006; H01Q 21/28

USPC ..... 343/702

See application file for complete search history.

(56) References Cited

U.S. PATENT DOCUMENTS

| | | | | |
|---|---|---|---|---|
| 6,414,643 | B2 * | 7/2002 | Cheng | G06F 1/1616 343/702 |
| 6,980,425 | B2 * | 12/2005 | Chuang | G06F 1/162 16/367 |
| 7,100,876 | B2 * | 9/2006 | Tseng | G06F 1/162 248/125.9 |
| 7,155,781 | B2 * | 1/2007 | Yamada | G06F 1/162 16/367 |

(Continued)

FOREIGN PATENT DOCUMENTS

| | | |
|---|---|---|
| CN | 1691415 | 11/2005 |
| TW | M307860 | 3/2007 |

(Continued)

OTHER PUBLICATIONS

"Office Action of Taiwan Counterpart Application," issued on Jan. 19, 2016, p. 1-p. 5.

*Primary Examiner* — Hoang V Nguyen

(74) *Attorney, Agent, or Firm* — Jianq Chyun IP Office

(57) ABSTRACT

An electronic device having antenna structure is provided. The electronic device includes a first body, a pivot assembly, a second body and an antenna structure. The pivot assembly is pivoted to the first body along a first axis. The second body is pivoted to the pivot assembly along a second axis. The antenna structure is disposed in the pivot assembly and has a first radiation portion, a second radiation portion and a third radiation portion. The first radiation portion and the second radiation portion have a slot therebetween to form a slot antenna. The third radiation portion forms a monopole antenna and is aligned to the slot. The third radiation portion and the slot are not coplanar.

13 Claims, 6 Drawing Sheets

(56) References Cited

U.S. PATENT DOCUMENTS 7,551,142 B1 * 6/2009 Zhang ..... H01Q 1/243 343/700 MS
8,059,040 B2 * 11/2011 Ayala Vazquez ..... H01Q 1/02 343/700 MS
8,508,415 B2 * 8/2013 Ikegaya ..... H01Q 5/364 343/702
8,976,522 B2 * 3/2015 Yen ..... G06F 1/162 312/209
2004/0090378 A1 * 5/2004 Dai ..... H01Q 1/22 343/700 MS
2015/0236426 A1 * 8/2015 Zhu ..... H01Q 13/10 343/702

FOREIGN PATENT DOCUMENTS

TW 201204952 2/2012
TW 201346496 11/2013

* cited by examiner

ELECTRONIC DEVICE HAVING ANTENNA STRUCTURE

CROSS-REFERENCE TO RELATED APPLICATION

This application claims the priority benefits of U.S. provisional application Ser. No. 61/979,505, filed on Apr. 14, 2014. The entirety of the above-mentioned patent application is hereby incorporated by reference herein and made a part of this specification.

BACKGROUND OF THE INVENTION

1. Field of the Invention

The invention relates to an electronic device, and more particularly, to an electronic device having an antenna structure.

2. Description of Related Art

Following the advancement of technology, current mass communication means have gradually been changed to wireless communication; devices such as smart phone, tablet PC with wireless Internet access, notebook computer and so forth are all fall within the scope of wireless communication; and in general, the wireless communication requires the use of an antenna to transmit messages.

In recent year, due to a means of intuitive touch operation and entertainment provided by the tablet PC, consumer market of the portable computer is divided by different functionalities between the tablet PC and the notebook computer divide. In order to satisfy consumer demand for commerce and entertainment, transformable notebook computer combining the notebook computer and the tablet PC gradually becomes one of the products favored by the consumer, screen of the transformable notebook computer may actuate to various positions in relative to the host for transforming into a variety of operating states. As such, an antenna is generally disposed within a casing of the screen, so that when the screen actuates in a manner, as described in the above, to change relative positions of the antenna and the metal casing of the host, the metal casing may shield the antenna and influence the signal transceiving ability of the antenna.

SUMMARY OF THE INVENTION

The invention is directed to an electronic device, whereby an antenna structure thereof has stable signal transceiving ability.

The electronic device having the antenna structure of the invention includes a first body, a pivot assembly, a second body, and the antenna structure. The pivot assembly is pivoted to the first body along a first axis. The second body is pivoted to the pivot assembly along a second axis. The antenna structure is disposed in the pivot assembly and has a first radiation portion, a second radiation portion and a third radiation portion. The first radiation portion and the second radiation portion have a slot therebetween to form a slot antenna. The third radiation portion forms a monopole antenna and is aligned to the slot. The third radiation portion and the slot are not coplanar.

In one embodiment of the invention, the second body is opened from or closed to the first body through a relative pivoting between the first body and the pivot assembly along the first axis.

In one embodiment of the invention, the first axis is perpendicular to the second axis.

In one embodiment of the invention, the pivot assembly has a metal shaft, the antenna structure has a grounding portion, and the grounding portion is connected to the metal shaft.

In one embodiment of the invention, a length of the slot is equal to one-fourth or one-half of a wavelength of a first signal, a length of the third radiation portion equals to one-fourth of a wavelength of a second signal.

In one embodiment of the invention, a frequency of the second signal is greater than a frequency of the first signal.

In one embodiment of the invention, the antenna structure has a connecting section, the connecting section is connected with the first radiation portion and located in the slot, the third radiation portion includes a first section and a second section that are bent with each other, and the first section is connected between the connecting section and the second section.

In one embodiment of the invention, the electronic device further includes a cable, wherein the cable includes a signal line and a ground line, the connecting section has a feed point, the second radiation portion has a ground point, the signal line is connected to the feed point, and the ground line is connected to the ground point.

In one embodiment of the invention, the pivot assembly has a plastic casing, and the antenna structure is disposed on the plastic casing.

In one embodiment of the invention, the pivot assembly has a metal casing, and the antenna structure is disposed on the metal casing.

In one embodiment of the invention, the pivot assembly has a plastic member, and the plastic member is engaged in the metal casing and aligned to the slot.

In one embodiment of the invention, the second radiation portion has a folded wall.

In one embodiment of the invention, the slot has an open end, the antenna structure has a feed point in the slot, and a width of the slot gradually increases from the feed point towards the open end.

In one embodiment of the invention, the slot is a closed slot.

In view of the above, in the electronic device of the invention, the antenna structure, instead of being disposed in the second body, is disposed in the pivot assembly; and therefore, when the second body actuates in relative to the first body, relative positions of the antenna structure and the first body do not change substantially following a movement of the second body, so that the antenna structure is prevented from being shielded by a metal casing of the first body, thus providing the antenna structure with stable signal transceiving ability. In addition, the antenna structure of the invention forms the slot antenna with the slot between the first radiation portion and the second radiation portion, and forms the monopole antenna with the third radiation portion, so as to cover a larger antenna operating frequency band with the coordination between the slot antenna and the monopole antenna. Moreover, in the invention, since the third radiation portion and the slot are not coplanar, the slot antenna and the monopole antenna do not interfere with each other and both have favorable signal transceiving ability.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
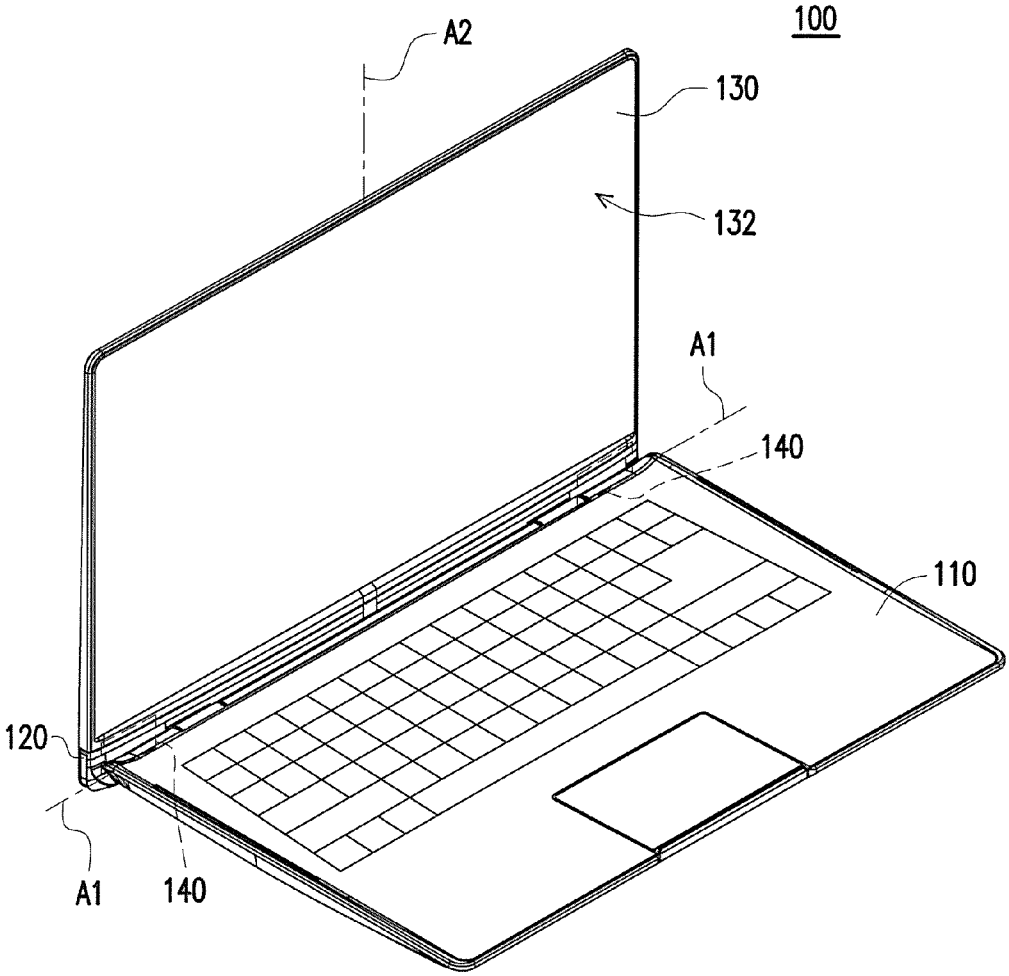
FIG. 1 is a perspective diagram illustrating an electronic device according to an embodiment of the invention.

FIG. 1 is a perspective diagram illustrating an electronic device according to an embodiment of the invention. Referring to FIG. 1, an electronic device 100 of the present embodiment includes a first body 110, a pivot assembly 120, a second body 130, and at least one antenna structure 140 (illustrated as two). The first body 110, for example, is a host of the electronic device 100, and the pivot assembly 120 is pivoted to the first body 110 along a first axis A1. The second body 120, for example, is a screen of the electronic device 100, and is pivoted to the pivot assembly 120 along a second axis A2, wherein the first axis A1, for example, is perpendicular to the second axis A2. The antenna structure 140 is disposed within the pivot assembly 120.

Figure 2:
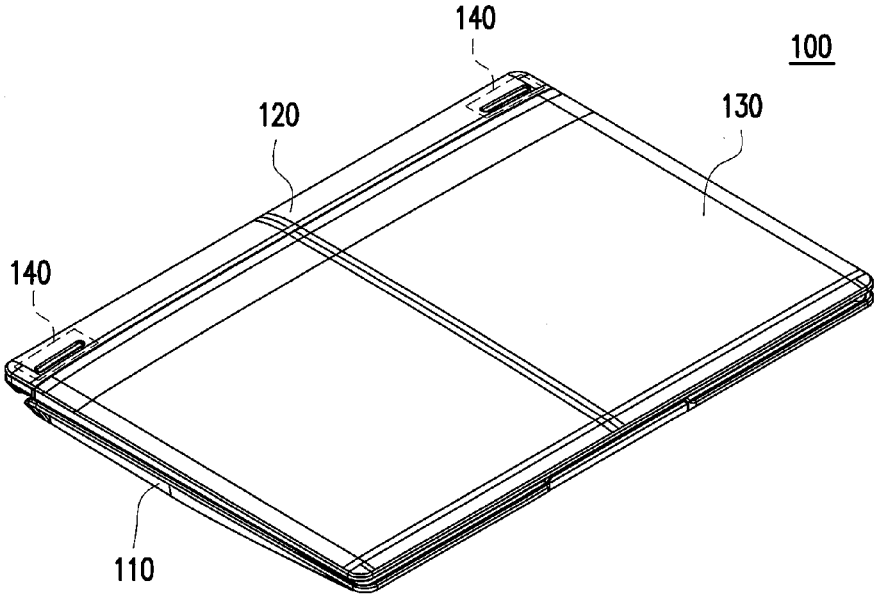
FIG. 2 and FIG. 3 illustrate a second body of FIG. 1 actuating in relative to a first body.
Figure 3:
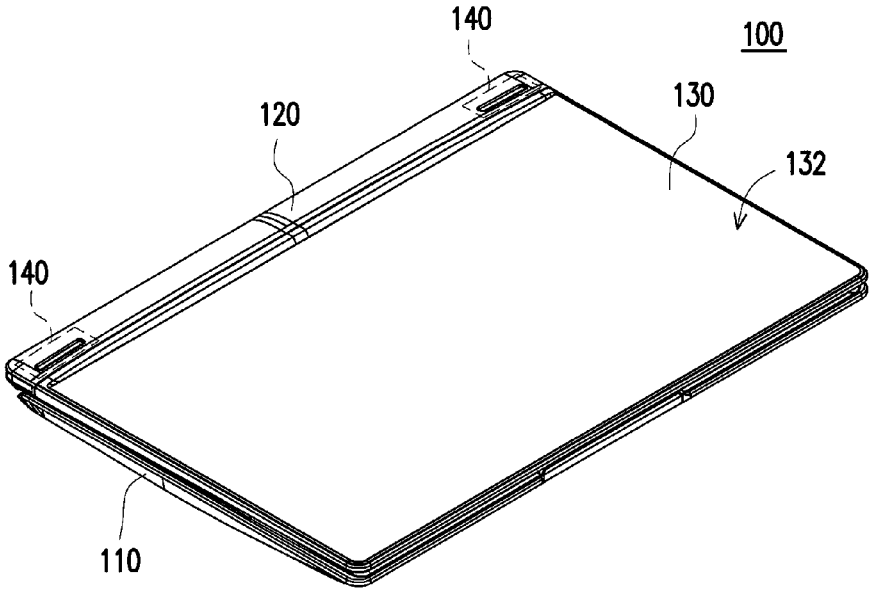

FIG. 2 and FIG. 3 illustrate a second body of FIG. 1 actuating in relative to a first body. The second body 130 may be closed to the first body 110, as shown in FIG. 2, or opened from the first body, as shown in FIG. 1, through a relative pivoting between the first body 110 and the pivot assembly 120 along the first axis A1, which being an operation mode of a notebook computer. In addition, through a relative pivoting between the second body 130 and the pivot assembly 120 along the second axis A2, when the second body 130 is closed to the first body 110, as shown in FIG. 3, a display surface 132 of the second body 130 is located an external side of the electronic device 100, which being an operation mode of a tablet PC.

Since the antenna structure 140, instead of being disposed in the second body 130, is disposed in the pivot assembly 120, when the second body 130 actuates in relative to the first body 110, as shown in FIG. 1 to FIG. 3, relative positions of the antenna structure 140 and the first body 110 do not change substantially following the movement of the second body 130, so that the antenna structure 140 is prevented from being shielded by a metal casing of the first body 110, thus providing the antenna structure 140 with stable signal transceiving ability.

Figure 4:
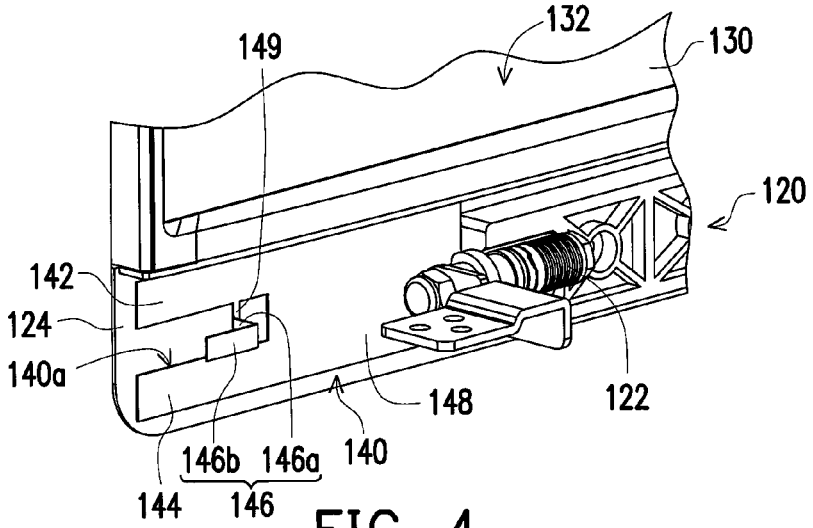
FIG. 4 is perspective diagram illustrating partial structure of the electronic device shown in FIG. 1 at the location of an antenna structure.
Figure 5:
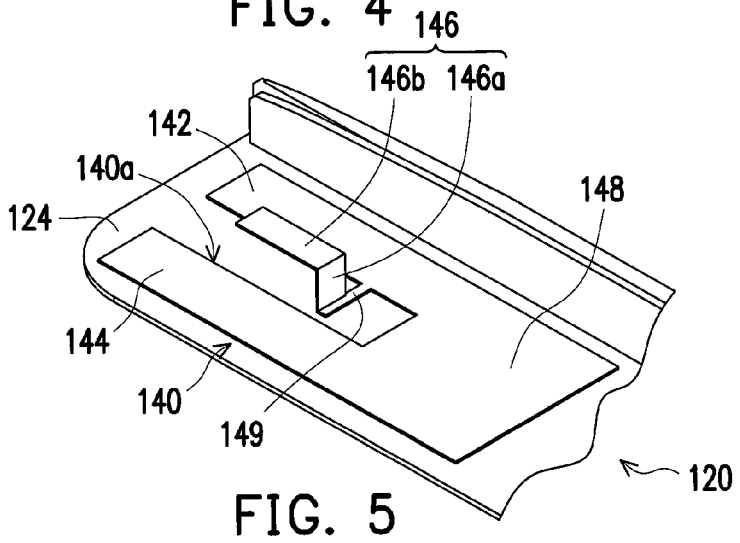
FIG. 5 is a perspective diagram illustrating the partial structure of the electronic device shown in FIG. 4 from another point of view.

FIG. 4 is perspective diagram illustrating partial structure of the electronic device shown in FIG. 1 at the location of an antenna structure. FIG. 5 is a perspective diagram illustrating the partial structure of the electronic device shown in FIG. 4 from another point of view. Referring to FIG. 4 and FIG. 5, the antenna structure 140 of the present embodiment has a first radiation portion 142, a second radiation portion 144, a third radiation portion 146, and a grounding portion 148. The first radiation portion 142 and the second radiation portion 144 have a slot 140*a* therebetween to form a slot antenna. The third radiation portion 146 forms a monopole antenna and is aligned to the slot 140*a*. The pivot assembly 120 has a metal shaft 122 and pivots in relative to the first body 110 via the metal shaft 122, and the grounding portion 148 is connected to the metal shaft 122 so as to be grounded, wherein the metal shaft 122, for example, is connected to the metal casing of the first body 110, such that the metal shaft 122 and the metal casing of the first body 110 forms a grounding surface.

In the present embodiment, the slot 140*a*, for example, is a open slot and a length thereof, for example, equals to one-fourth of a wavelength of a first signal, a length of the third radiation portion 146, for example, equals one-fourth of a wavelength of a second signal, and a frequency of the second signal, for example, is greater than a frequency of the first signal. For instance, a frequency band of the first signal is approximately 2.4 GHz, whereby a frequency band of the second signal is approximately 5 GHz. With the coordination between the slot antenna and the monopole antenna, the antenna structure 140 may cover a larger antenna operating frequency band.

As shown in FIG. 5, the antenna structure 140 of the present embodiment has a connecting section 149, and the connecting section 149 is connected with the first radiation portion 142 and located in the slot 140*a*. The third radiation portion 146 includes a first section 146*a* and a second section 146*b* that are bent with each other, and the first section 146*a* is connected between the connecting section 149 and the second section 146*b*. With such configuration, the third radiation portion 146 and the slot 140*a* may be non-coplanar with each other, and thus the slot antenna and the monopole antenna do not interfere with each other and may both have favorable signal transceiving ability.

Figure 6:
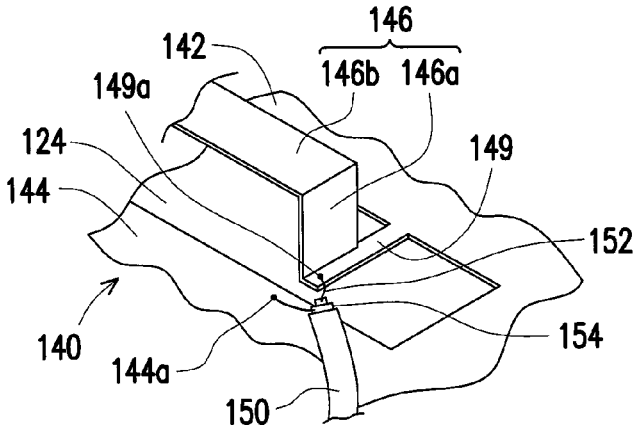
FIG. 6 is a partial enlarged diagram of the electronic device shown in FIG. 5.

FIG. 6 is a partial enlarged diagram of the electronic device shown in FIG. 5. Referring to FIG. 6, the electronic device 100 (as depicted in FIG. 1 to FIG. 3) further includes a cable 150, and the cable 150 includes a signal line 152 and a ground line 154. The connecting section 149 has a feed point 149*a*, the second radiation portion 144 has a ground point 144*a*, the signal line 152 is connected to the feed point 149*a*, and the ground line 154 is connected to the ground point 144*a*, so that the antenna structure 140 may feed the signals via the cable 150.

Figure 7:
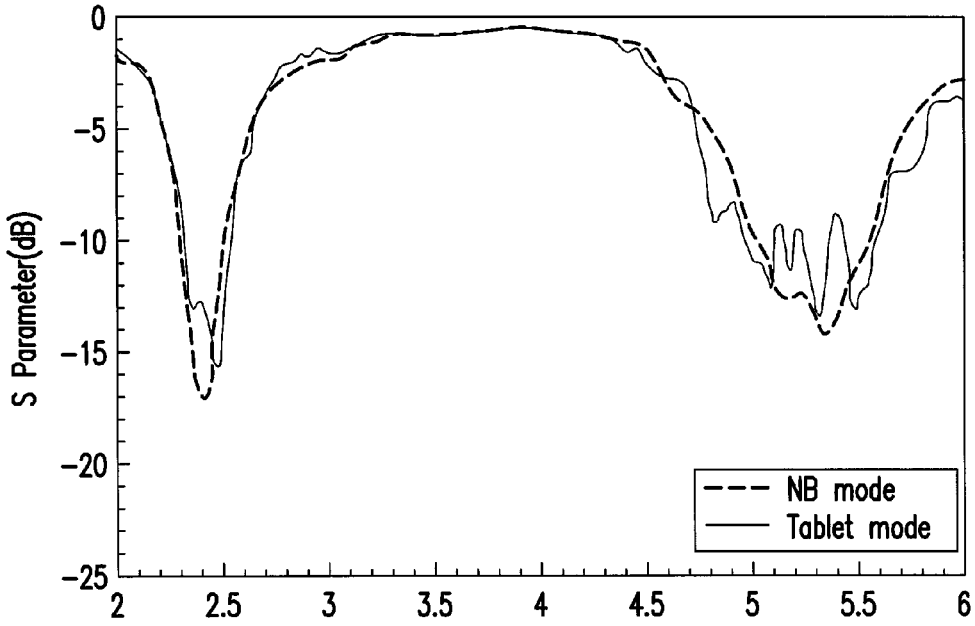
FIG. 7 a schematic diagram illustrating characteristics of S-parameters of the antenna structure shown in FIG. 1.

FIG. 7 a schematic diagram illustrating characteristics of S-parameters of the antenna structure shown in FIG. 1, wherein a NB mode in the figure represents the operation mode of the notebook computer shown in FIG. 1, and a Tablet mode in the figure represent the operation mode of the tablet PC shown in FIG. 3. As shown in FIG. 7, for the antenna structure configured by the above approach, S-parameters thereof are lower than −10 dB operational frequency bands of 2.4 GHz and 5 GHz, and thus the antenna structure has favorable characteristic performance. In addition, a table below shows radiation efficiencies of the antenna structure of FIG. 1 at different operational frequency bands, whereby the NB mode in the table represents the operation mode of the notebook computer shown in FIG. 1, and the Tablet mode in the table represents the operation mode of the table PC shown in FIG. 3. As shown in the table below, for the antenna structure configured by the above approach, qualified radiation efficiencies thereof the operational frequency bands of 2.4 GHz and 5 GHz are higher than 40% of the operation requirement.

| | Frequency (GHz) | | | | | |
|---|---|---|---|---|---|---|
| | 2.40 | 2.45 | 2.50 | 5.15 | 5.50 | 5.85 |
| NB mode | 77.25% | 72.14% | 71.13% | 68.32% | 67.28% | 41.47% |
| Tablet mode | 72.77% | 77.33% | 75.38% | 63.91% | 67.60% | 54.52% |

Referring to FIG. 4 and FIG. 5, the pivot assembly 120 of the present embodiment has a plastic casing 124, and the antenna structure 140 is disposed on the plastic casing 124. Nevertheless, the invention does not intend to limit the material of the casing of the pivot assembly 120; and an example thereof, accompanied by a drawing, is described in below.

Figure 8:
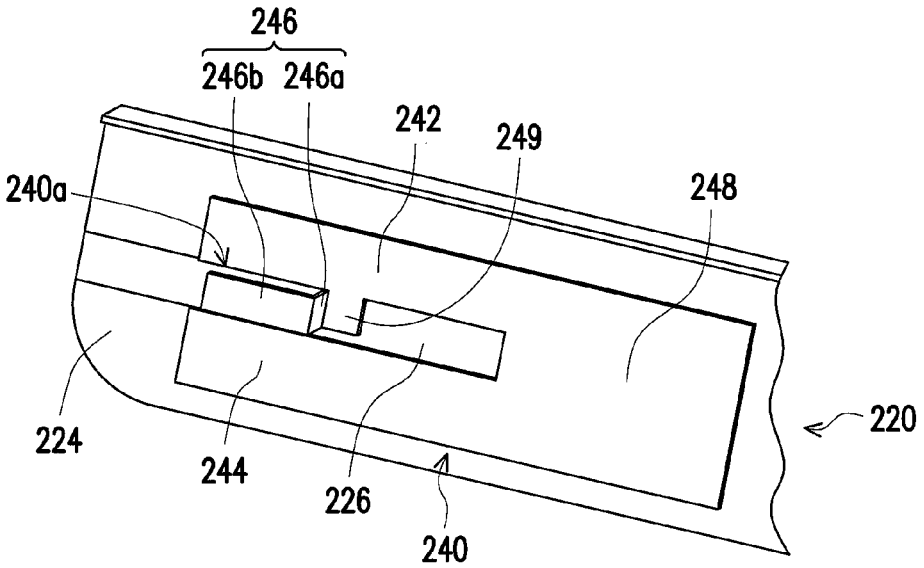
FIG. 8 is perspective diagram illustrating partial structure of an electronic device at the location of an antenna structure according to another embodiment of the invention.

FIG. 8 is perspective diagram illustrating partial structure of an electronic device at the location of an antenna structure according to another embodiment of the invention. In the embodiment of FIG. 8, configurations and mode of actions of an antenna structure 240, a slot 240*a*, a first radiation portion 242, a second radiation portion 244, a third radiation portion 246, a first section 246*a*, a second section 246*b*, a grounding portion 248, and a connecting section 249 are similar to that of the antenna structure 140, the slot 140*a*, the first radiation portion 142, the second radiation portion 144, the third radiation portion 146, the first section 146*a*, the second section 146*b*, the grounding portion 148, and the connecting section 149 shown in FIG. 5, and thus are not to be repeated. Differences between the embodiment shown in FIG. 8 and the embodiment shown in FIG. 5 lie in that, the pivot assembly 220 has a metal casing 224 and a plastic member 226, the antenna structure 240 is disposed on the metal casing 224 and the plastic member 226 is engaged in the metal casing 224 and aligned to the slot 240*a*, so that the metal casing 224 forms a part of the antenna.

Figure 9:
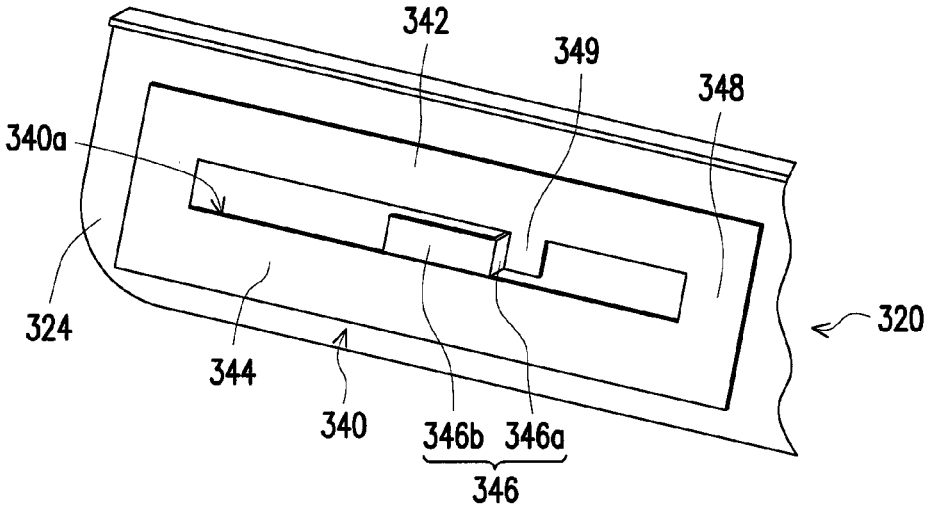
FIG. 9 is perspective diagram illustrating partial structure of an electronic device at the location of an antenna structure according to another embodiment of the invention.

Other embodiments of the antenna structure of the invention, accompanied by drawings, are further described in below. FIG. 9 is perspective diagram illustrating partial structure of an electronic device at the location of an antenna structure according to another embodiment of the invention. In the embodiment shown in FIG. 9, configurations and mode of actions of a pivot assembly 320, a plastic casing 324, a first radiation portion 342, a second radiation portion 344, a third radiation portion 346, a first section 346*a*, a second section 346*b*, a grounding portion 348, and a connecting section 349 are similar to that of the pivot assembly 120, the plastic casing 124, the first radiation portion 142, the second radiation portion 144, the third radiation portion 146, the first section 146*a*, the second section 146*b*, the grounding portion 148, and the connecting section 149 shown in FIG. 5, and thus are not to be repeated herein. Differences between the embodiment shown in FIG. 9 and the embodiment shown in FIG. 5 lie in that, a slot 340*a* of the antenna structure 340 is a closed slot, and a length of the slot 340*a*, for example, equals one-half the wavelength of the first signal.

Figure 10:
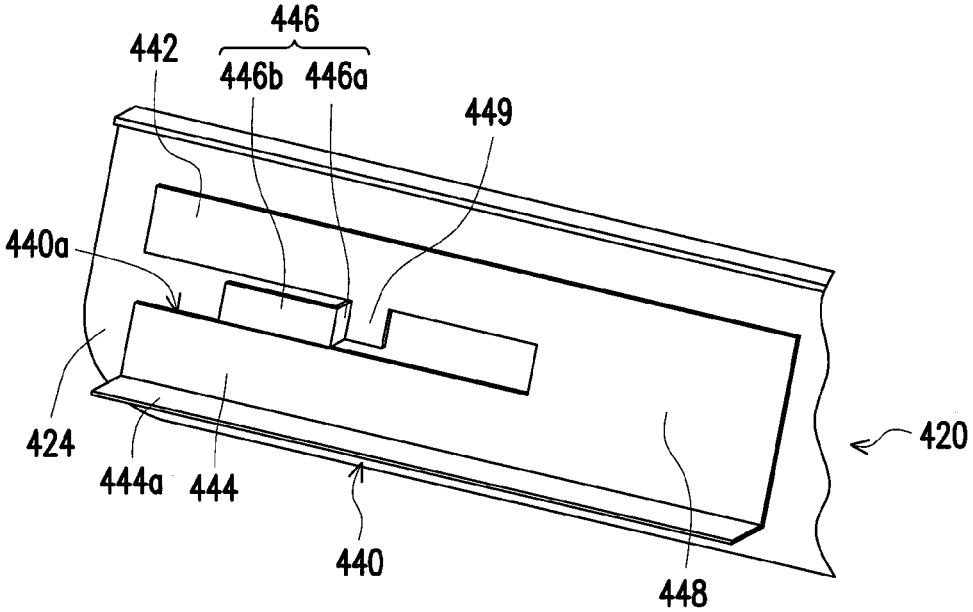
FIG. 10 is perspective diagram illustrating partial structure of an electronic device at the location of an antenna structure according to another embodiment of the invention.

FIG. 10 is perspective diagram illustrating partial structure of an electronic device at the location of an antenna structure according to another embodiment of the invention. In the embodiment shown in FIG. 10, configurations and mode of actions of a pivot assembly 420, a plastic casing 424, a slot 440*a*, a first radiation portion 442, a third radiation portion 446, a first section 446*a*, a second section 446*b*, a grounding portion 448, and a connecting section 449 are similar to that of the pivot assembly 120, the casing 124, the slot 140*a*, the first radiation portion 142, the third radiation portion 146, the first section 146*a*, the second section 146*b*, the grounding portion 148, and the connecting section 149 shown in FIG. 5, and thus are not to be repeated herein. A difference between the embodiment shown in FIG. 10 and the embodiment shown in FIG. 5 lies in that, a second radiation portion 444 of the antenna structure 440 has a folded wall 444*a*, thereby capable of increasing an area of the second radiation portion 444 for enhancing signal transceiving ability.

Figure 11:
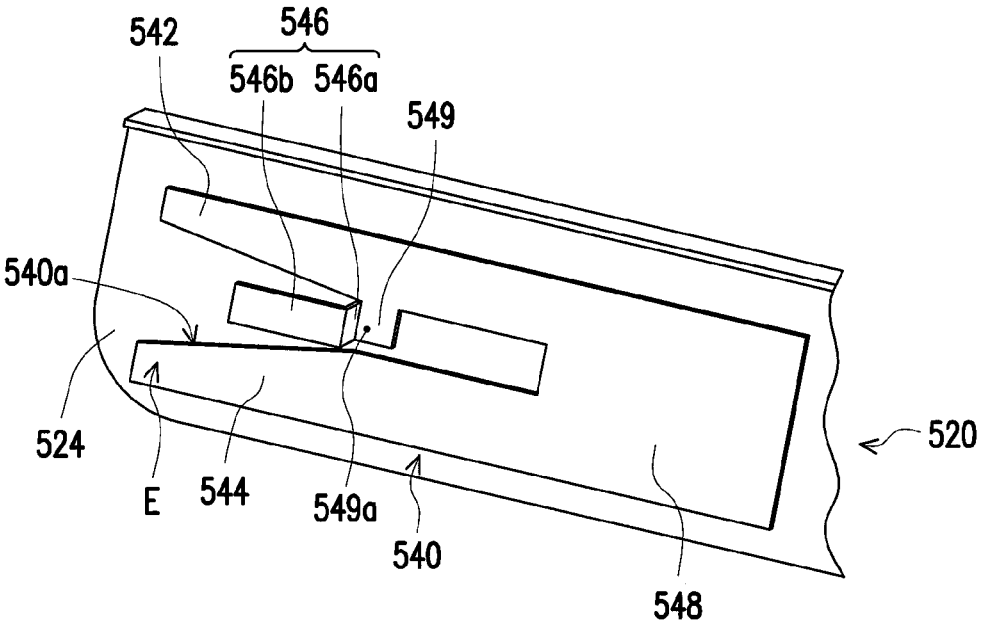
FIG. 11 is perspective diagram illustrating partial structure of an electronic device at the location of an antenna structure according to another embodiment of the invention.

FIG. 11 is perspective diagram illustrating partial structure of an electronic device at the location of an antenna structure according to another embodiment of the invention. In the embodiment shown in FIG. 11, configurations and mode of actions of a pivot assembly 520, a plastic casing 524, a first radiation portion 542, a second radiation portion 544, a third radiation portion 546, a first section 546*a*, a second section 546*b*, a grounding portion 548, and a connecting section 549 are similar to that of the pivot assembly 120, the casing 124, the first radiation portion 142, the second radiation portion 144, the third radiation portion 146, the first section 146*a*, the second section 146*b*, the grounding portion 148, and the connecting section 149 shown in FIG. 5, and thus are not to be repeated herein. A difference between the embodiment shown in FIG. 11 and the embodiment shown in FIG. 5 lies in that, a width of the slot 540*a* gradually increases from the feed point 549*a* towards an open end E of the slot 540*a*, so as to increase a distances between the first radiation portion 542 and the second radiation portion 544 at the open end E, thereby capable of lowering an electric field coupling effect of the slot 540*a* at the open end E.

In summary, in the electronic device of the invention, the antenna structure, instead of being disposed in the second body, is disposed in the pivot assembly; and therefore, when the second body actuates in relative to the first body, the relative positions of the antenna structure and the first body do not change substantially following the movement of the second body, so that the antenna structure is prevented from being shielded by the metal casing of the first body, thus providing the antenna structure with stable signal transceiving ability. In addition, the antenna structure of the invention forms the slot antenna with the slot between the first radiation portion and the second radiation portion, and forms the monopole antenna with the third radiation portion, so as to cover a larger antenna operating frequency band with the coordination between the slot antenna and the monopole antenna. Moreover, in invention, since the third radiation portion and the slot are not coplanar, the slot antenna and the monopole antenna do not interfere with each other and both have favorable signal transceiving ability.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic device, comprising:

a first body;

a pivot assembly, pivoted to the first body along a first axis;

a second body, pivoted to the pivot assembly along a second axis;

at least one antenna structure, disposed in the pivot assembly and having a first radiation portion, a second radiation portion and a third radiation portion, wherein the first radiation portion and the second radiation portion have a slot therebetween to form a slot antenna, the third radiation portion forms a monopole antenna and is aligned to the slot, and the third radiation portion and the slot are not coplanar, wherein the antenna structure has a connecting section, the connecting section is connected with the first radiation portion and located in the slot, the third radiation portion comprises a first section and a second section that are bent with each other, and the first section is connected between the connecting section and the second section.

2. The electronic device as recited in claim 1, wherein the second body is opened from or closed to the first body through a relative pivoting between the first body and the pivot assembly along the first axis.

3. The electronic device as recited in claim 1, wherein the first axis is perpendicular to the second axis.

4. The electronic device as recited in claim 1, wherein the pivot assembly has a metal shaft, the antenna structure has a grounding portion, and the grounding portion is connected to the metal shaft.

5. The electronic device as recited in claim 1, wherein a length of the slot is equal to one-fourth or one-half of a wavelength of a first signal, a length of the third radiation portion equals to one-fourth of a wavelength of a second signal.

6. The electronic device as recited in claim 5, wherein a frequency of the second signal is greater than a frequency of the first signal.

7. The electronic device as recited in claim 1, further comprising a cable, wherein the cable comprises a signal line and a ground line, the connecting section has a feed point, the second radiation portion has a ground point, the signal line is connected to the feed point, and the ground line is connected to the ground point.

8. The electronic device as recited in claim 1, wherein the pivot assembly has a plastic casing, and the antenna structure is disposed on the plastic casing.

9. The electronic device as recited in claim 1, wherein the pivot assembly has a metal casing, and the antenna structure is disposed on the metal casing.

10. The electronic device as recited in claim 9, wherein the pivot assembly has a plastic member, and the plastic member is engaged in the metal casing and aligned to the slot.

11. The electronic device as recited in claim 1, wherein the second radiation portion has a folded wall.

12. The electronic device as recited in claim 1, wherein the slot has an open end, the antenna structure has a feed point in the slot, and a width of the slot gradually increases from the feed point towards the open end.

13. The electronic device as recited in claim 1, wherein the slot is a closed slot.

* * * * *